United States Patent [19]

Dixon

[11] Patent Number: 4,731,016

[45] Date of Patent: Mar. 15, 1988

[54] EXPLOSION RELIEF SEALING APPARATUS FOR A PAINT BAKING OVEN

[75] Inventor: James M. Dixon, Washington, Mich.

[73] Assignee: Tri-Mark Metal Corporation, Detroit, Mich.

[21] Appl. No.: 10,396

[22] Filed: Feb. 3, 1987

[51] Int. Cl.[4] ..... F27D 21/00

[52] U.S. Cl. ..... 432/35; 110/193; 52/1; 34/242; 126/190

[58] Field of Search ..... 52/1, 262, 284; 34/242; 110/173 B, 193, 237; 432/35, 76; 126/190

[56] References Cited

U.S. PATENT DOCUMENTS 4,094,108 6/1978 Scott ..... 52/1

4,308,695 1/1982 Ehrsam ..... 52/1

FOREIGN PATENT DOCUMENTS 625008 8/1978 U.S.S.R. ..... 52/1

*Primary Examiner*—Samuel Scott

*Assistant Examiner*—Noah Kamen

*Attorney, Agent, or Firm*—Barnes, Kisselle, Raisch, Choate, Whittemore & Hulbert

[57] ABSTRACT

A releasable and gas tight sealing apparatus for construction panels of a paint baking oven which relieves the buildup of gas pressure within the oven in the event of an explosion. The apparatus has tongue and groove members and a compressible cord rope received in the groove members. In assembly and during normal use of the oven, the tongue is received in the groove and bears on and compresses the cord rope to provide a gas tight seal. In the event of an explosion, the construction panels are forced outwardly which disengages the tongue and groove members and relieves the buildup of gas pressure in the oven.

13 Claims, 6 Drawing Figures

EXPLOSION RELIEF SEALING APPARATUS FOR A PAINT BAKING OVEN

FIELD OF THE INVENTION

This invention relates to an apparatus providing a releasable and gas tight seal between construction members of a paint baking oven, which relieves gas pressure in the event of an explosion.

BACKGROUND OF THE INVENTION

Typically, paint baking ovens are constructed from a plurality of modules. Each module usually has top, side and bottom panels. Each of these panels preferably has a pair of spaced apart metal sheets with an insulating material such as rockwool or fiberglass disposed between them. Ordinarily, the side and bottom panels are welded together at ninety degree angles. Usually, the top panels are carried by the side panels. Typically, each module has a longitudinal length of about ten feet and adjacent modules are connected together by expansion joints to produce an oven having the desired length which is often in excess of two hundred feet.

In ovens using a direct open flame to produce heat and hot gases to bake the paint, there is the potential for an explosion by ignition of the volatile organic compounds being vaporized from the wet paint as it bakes. In the event of an explosion, absent a means of relieving the gas pressure within the oven, it would be damaged or destroyed and could cause injury to persons and other property.

In prior direct flame ovens, explosion relief has been provided by unrestraining the top panels so the gas pressure produced by an explosion could force or blow the top panels off the oven. Portions of the top panels were overlapped with the side panels and the interface therebetween was sealed with an oven cement in an attempt to prevent hot gases from blowing out of the oven during normal operating conditions. Due to continual heating and cooling of the oven, this oven cement becomes brittle, cracks, separates from the panels, and falls into the interior of the oven. This produces leaks of noxious gases from the oven and condensation of organic compounds on the exterior of the oven. Furthermore, the cement particles fall onto and cause imperfections in the paint being baked in the oven. Moreover, use of silicone sealants resulted in deleterious reactions with the paint beng baked in the oven.

Prior to this invention, no apparatus has been developed which is effective throughout the life of the oven in providing a releasable seal that is impervious to the passage of particulate matter, noxious gases and volatile organic compounds, while simultaneously providing a means to relieve gas pressure in the event of an explosion.

SUMMARY OF THE INVENTION

An apparatus for providing a releasable and gas tight seal between adjacent construction panels of baking ovens having a longtudinally extending tongue, a longitudinally extending groove, and a flexible cord rope received in the groove. The tongue and groove are constructed and arranged so that in assembly the tongue bears on and compresses the cord rope thereby forming a releasable seal between adjacent construction panels.

Objects, features and advantages of this invention are to provide an oven explosion relief apparatus having a seal that is impervious to the passage of particulate matter, gases and volatile organic compounds, readily and dependably releasable in the event of an explosion, rugged, durable, economical to manufacture, easy to assemble, and has a long in service life.

BRIEF DESCRIPTION OF THE DRAWINGS

These and other objects, features and advantages of this invention will be apparent from the following detailed description, appended claims and accompanying drawings in which:

DESCRIPTION OF PREFERRED EMBODIMENT OF THE INVENTION

Figure 1:
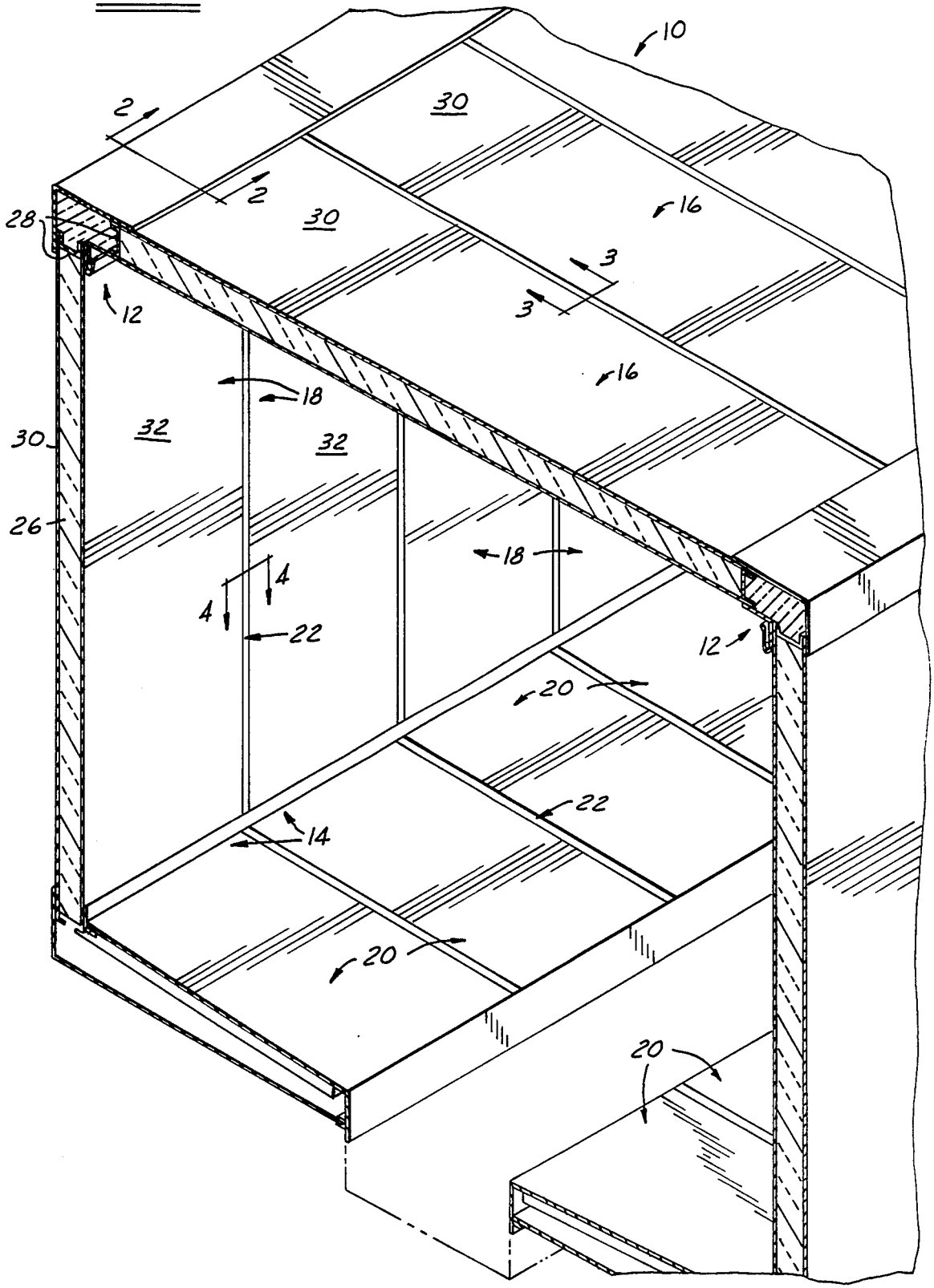
FIG. 1 is a fragmentary perspective view of a paint bake oven embodying this invention.

Referring in more detail to the drawings, FIG. 1 illustrates a paint bake oven 10 having an explosion relief sealing apparatus 12 embodying this invention. This oven bakes paint on a substrate using a direct open flame of natural gas to heat air circulated through the oven. In use, typically the interior of the oven is heated to a temperature in the range of about 120° F. to 450° F.

The paint bake oven is of modular construction with a plurality of modules 14 which are self supporting. Each module has top 16, side 18 and bottom panels 20. Adjacent modules are connected together by expansion joints 22 and 24. Typically each module is 10 feet high, 20 feet in longitudinal length and about 10 feet in transverse width.

Preferably, each panel is constructed with load bearing U-shaped side and end beams 26 and 28 received between two layers of sheet metal 30, 32 with an insulating material 34 received between them. Preferably, the two layers of sheet metal 30, 32 are positioned about six inches apart and are fixed to the beams 26 and 28 be welding. Preferably, the insulating material is fiberglass with a thermal rating of about $K=0.3$ BTU-in/hr $ft^2$°F. at 250° F.

Figure 4:
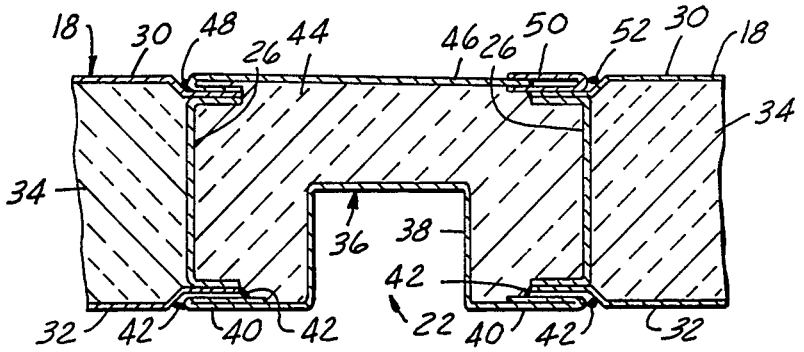
FIG. 4 is a fragmentary sectional view taken generally on line 4—4 in FIG. 1, and illustrating an expansion joint between adjacent side panels.

In assembly, preferably the adjacent ends of the side and bottom panels 18, 20 of each module are welded together at ninety degree angles. Adjacent side and bottom panels of adjacent modules are connected together by expansion joints 22 as shown in FIG. 4, to compensate for thermal expansion and contraction due to heating and cooling of the oven. Preferably, these expansion joints have a pleated sheet metal expansion member 36 having a generally U-shaped central portion with legs 38 terminating in attachment flanges 40. The flanges are fixed to the adjacent panels by seam welds 42 which also provide a gas tight seal between the panels and the expansion member. Preferably, an insulating material 44 is placed over the expansion member and between the adjacent panels.

The gap between the outer faces of the adjacent panels and the insulation is covered by a cover plate 46 fixed adjacent one edge to one panel by spot welds 48. To permit expansion and contraction the other edge of the cover is slidably received in a U-shaped strip 50 fixed to the other panel by spot welds 52.

Figure 2:
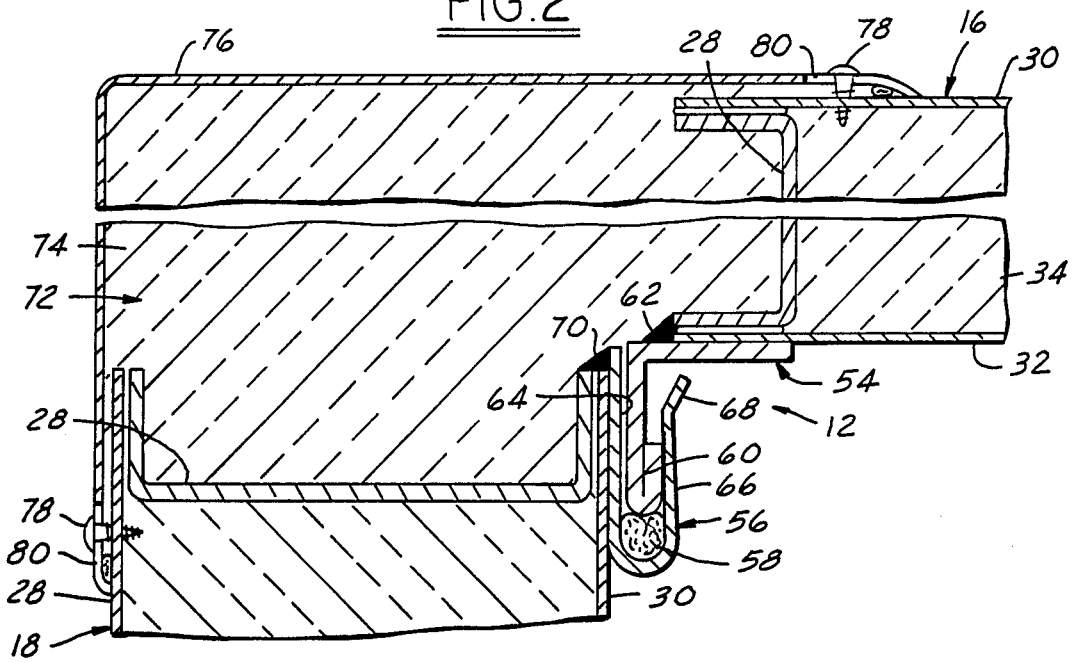
FIG. 2 is an enlarged fragmentary sectional view taken generally on line 2—2 in FIG. 1, and illustrating a sealing apparatus of this invention between top and side panels of the oven.

In accordance with this invention, to provide explosion relief, the sealing apparatus 12 supports the top panels on the side panels without being restrained from upward movement and releasably seals them so that they can be easily blown or forced upwardly off the sides in the event of an explosion. As shown in FIG. 2, the apparatus has a tongue member 54, a groove member 56 and a cord rope 58 which is received in the groove.

Preferably the tongue member 54 is made of sheet metal with an L-shape and has a tongue 60, which in assembly projects into the groove and bears on the cord rope. The tongue member extends longitudinally and is fixed to each end of each top panel by a seam weld 62 which also provides a gas tight seal between the tongue and panel. Preferably, the groove member 56 is made of sheet metal with a generally U-shape and legs 64 and 66. To facilitate retaining the cord rope in the groove, preferably the legs are inclined toward each other to provide an entrance opening with a minimum width which is less than the maximum width of the bottom portion of the groove. To facilitate entry of the tongue into the groove, preferably leg 66 has a canted portion 68 at its free end. A groove member extends longitudinally across each side panel adjacent its upper end and is fixed to the panel by a continuous weld 70 which also provides a gas tight seal between the groove member and the panel.

In assembly, the weight of the top panel causes the tongue to bear on and compress the cord rope so that a seal is formed which is impervious to the flow of gases, volatile organic compounds and any particulate matter. The cord rope is made of a fire retardant and thermal resistant material, which is at least somewhat flexible, resilient and compressible. Preferably, the cord rope has a nominal diameter of about ¾" and is usually compressed by the tongue to a vertical height of about ½". A suitable cord rope is commercially available from Staff Company of 20148 Detroit Road, Cleveland, Ohio 44116 under the trade designation 1000° F. Fiberglass ¾" diameter braided "T"-cord.

Preferably, the nook or trough 72 formed at the outer edge of the juncture of the top and side panels is filled with an insulating material 74 such as fiberglass and covered with an L-shaped cover 76 fastened to the panels by screws 78. To permit the top panel to lift in the event of an explosion, the screws 78 are received in slots 80 opening into at least one outer edge and preferably both outer edges of the cover. The slots should have a width slightly greater than that of the stud portion of the screws.

Figure 3:
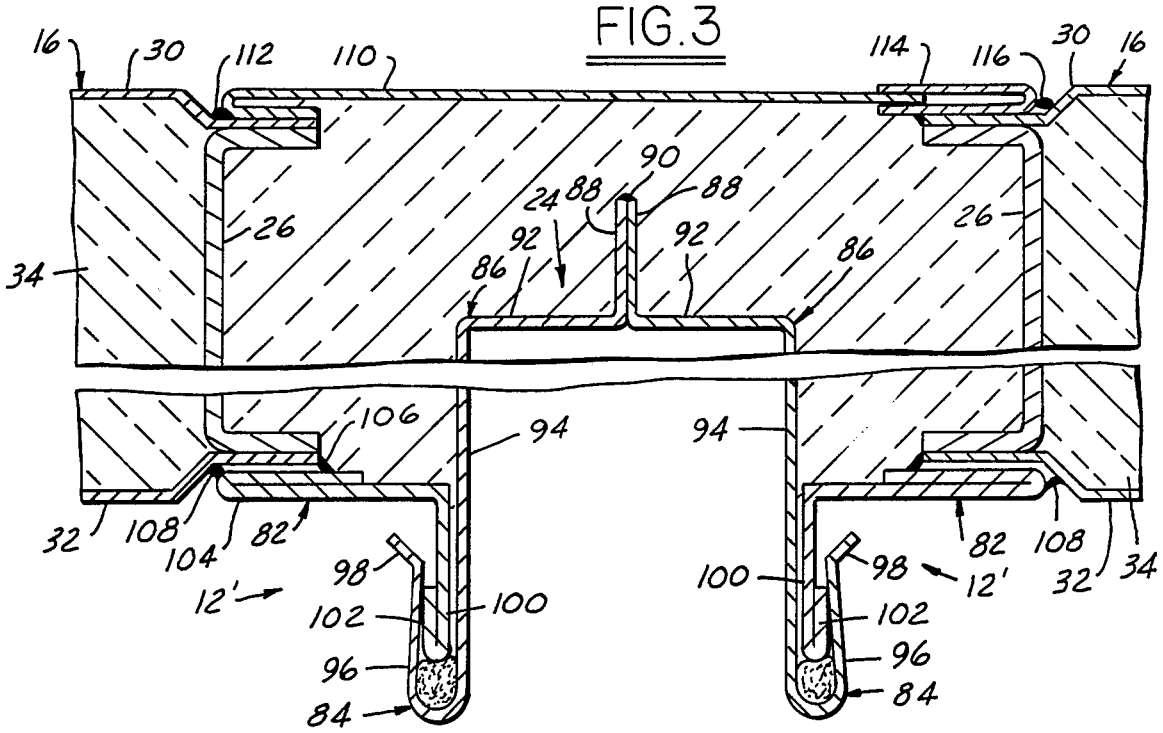
FIG. 3 is a fragmentary sectional view taken generally on line 3—3 in FIG. 1, and illustrating the sealing apparatus between an expansion joint and two adjacent top panels.

In accordance with this invention, a sealing apparatus 12' is also provided between the adjacent sides of adjacent top panels and the expansion joint 24 disposed between adjacent top panels. As shown in FIG. 3, preferably the sealing apparatus is combined with the expansion joint, although they could be fabricated separately and assembled together. The sealing apparatus has a tongue member 82 fixed to each panel and an associated groove member 84 which is preferably an integral part of the expansion joint. The ends of the expansion joint 24 are fixed to the side wall expansion joints 22 and extend between the side walls of the modules. To facilitate joining together adjacent modules the expansion joint is made of two sheet metal pieces 86 having flanges 88 fixed and sealed together by a continuous weld 90. Each piece 86 has a first leg 92 integral with the flange 88 and a second right angular leg 94 which flexes to compensate for expansion and contraction of the top panels due to temperature changes. Each groove member 84 is formed adjacent the lower edge of the leg 94 by a return bend portion 96 which is preferably inclined toward leg 94 and terminates in a canted portion 98 which facilitates insertion of the tongue.

Each tongue member 82 is made of sheet metal with a generally L-shape and one leg forming a tongue 100 which preferably has a reinforcing return bend portion 102. Preferably the other leg 104 also has a reinforcing return bend portion. Each tongue member extends longitudinally and is fixed and sealed to one side of a top panel adjacent its lower face by continuous welds 106 and 108. A cord rope 56 is received in the groove 84 of each sealing apparatus and is assembly is compressed by an associated tongue member.

Figure 5:
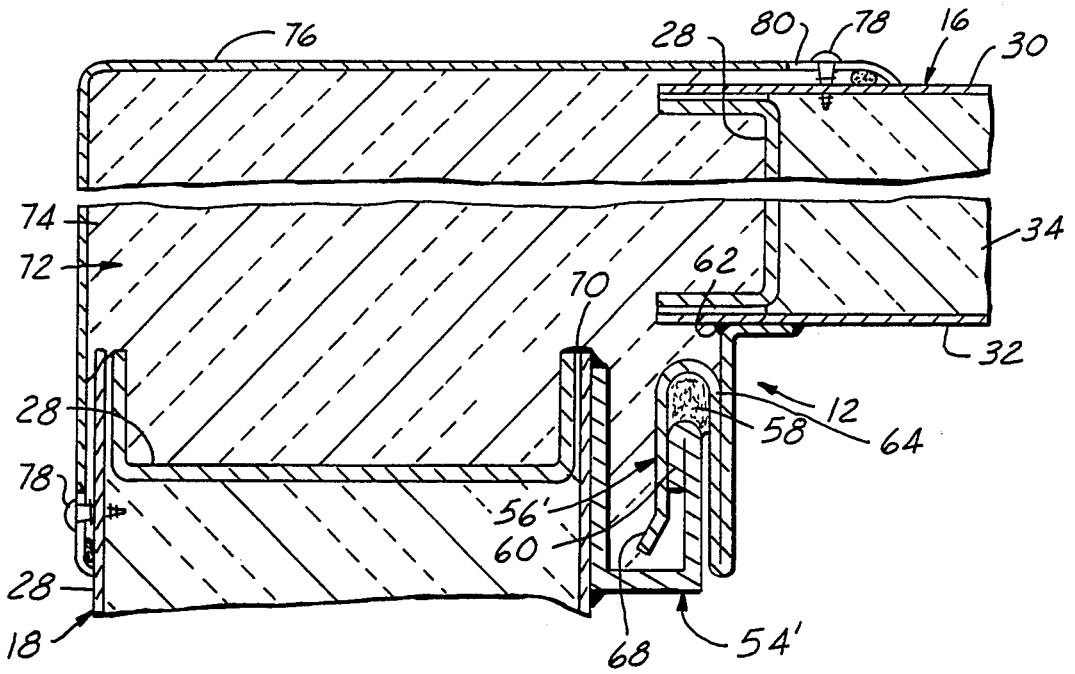
FIG. 5 is a fragmentary sectional view similar to FIG. 2 illustrating a modified mounting of the sealing apparatus of this invention between top and side panels of the oven.
Figure 6:
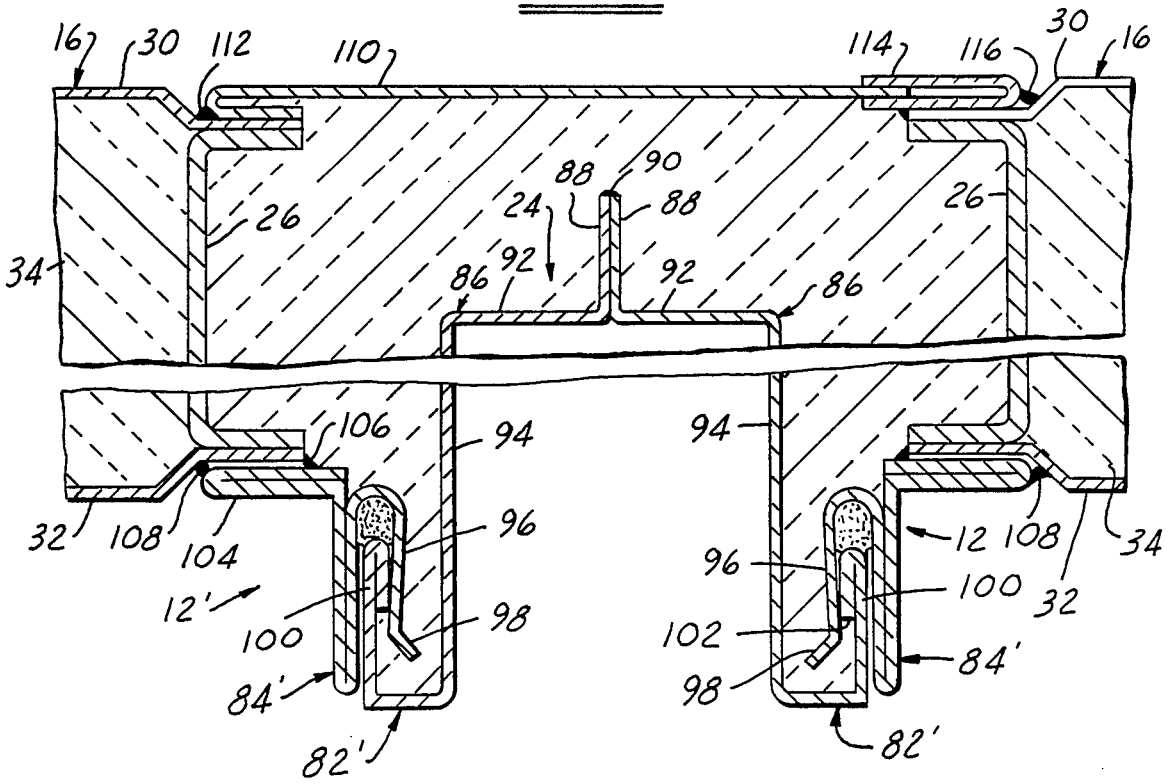
FIG. 6 is a sectional view similar to FIG. 3 illustrating a modified mounting of the sealing apparatus between an expansion joint and adjacent top panels.

If desired, the attachment of the tongue and groove members can be reversed. As shown in FIG. 5, the tongue member 54' can be secured to the top panel 16 and its associated groove member 56' secured to the side panel 18. Similarly, as shown FIG. 6, the tongue members 82' can be formed as part of the expansion joint 24 and their associated groove members 84' fixed to the top panels 16.

In assembly, insulation is placed over the expansion joint 24 and in the trough between adjacent top panels. The insulation is covered up by a cover plate 110 which preferably has a return bend adjacent one edge and is fixed adjacent one side edge to one of the panels by spot welds 112. To permit expansion and contraction, the cover plate is slidably received in a U-shaped member 114 which extends longitudinally along one side edge of the other panel and is fixed to it by spot welds 116.

In constructing an oven a plurality of the modules 14 are set up and adjacent modules are connected together by the expansion joints 22 and 24. The top panels are assembled by inserting the tongues along their ends and sides into associated grooves carried by the side walls and top expansion joints. Thereafter, insulation is inserted in the gaps between the panels and the covers are installed. In assembly and during normal use of the oven, the weight of each top panel causes its associated tongues to bear on and compress the cord ropes received in the associated grooves to provide a seal that is impervious to the flow of gases, volatile organic compounds or any particulate matter.

In the event of an explosion of volatile gases or materials within the oven, the rapidly increasing gas pressure is relieved by the top panels being forced generally vertically upward so they disengage from the side walls and thereby provide an opening which relieves or vents the pressurized gas to the exterior of the oven. This pressure relief prevents damage and destruction of the oven and injury to persons or property in the vicinity of the oven. After the cause of the explosion has been corrected, the top panels can again be readily assembled on the oven so that the oven again can be used.

What is claimed is:

1. A baking oven having a direct flame heating system which comprises: a plurality of modules each having a pair of upstanding and laterally spaced apart side panels, a top panel removably carried by such pair of side panels, first members having a longitudinally extending tongue, second members having a longitudinally extending tongue slidably received in said groove when assembled therewith and removable from said groove when such top panel disengages from such side panels, one of said members fixed and sealed to each side panel adjacent its upper end and the other of said members fixed and sealed to said top panel adjacent each of its ends, a flexible and compressible cord rope of a thermal resistant material received in and extending generally longitudinally of each groove, and when the top panel is carried by such side panels each tongue is received in an associated groove and bears on and compresses the rope cord received therein to thereby provide a releasable seal between the top panel and such side panels of the modules.

2. The oven of claim 1 wherein each of said first members has first and second legs integrally connected by a return bend to define said groove with said legs converging toward each other adjacent the open end of said groove to facilitate retention of said cord rope in said groove.

3. The oven of claim 2 wherein one of said legs terminates adjacent its free end in a portion inclined outwardly to both of said legs and constructed and arranged to guide the tongue into the groove.

4. The oven of claim 1 which also comprises insulation received in an opening defined in part by the upper end of the side panels and an adjacent end of the top panels, a cover overlying the insulation and adjacent portions of both the top and side panels, slots in said cover opening into one outer edge of said cover, fasteners with a head connected to a stud extending through said slots and into one of said side and top panels to releasably secure the cover, and said slots having a width slightly greater than that of the stud, whereby the top panel will not be prevented by the cover from being forced generally vertically upward in the event of an explosion in the oven.

5. The oven of claim 1 which also comprises insulation received in an opening defined in part by the upper end of the side panels and an adjacent end of the top panels, a cover overlying the insulation and adjacent portions of both the top and side panels, and fasteners extending through said cover and only one of said side and top panels to secure the cover without preventing the top panels from being forced generally vertically upward in the event of an explosion in the oven.

6. The oven of claim 1 which also comprises, an expansion joint extending between said laterally spaced apart side walls and received between an adjacent pair of top panels, a third member having a longitudinally extending groove, a fourth member having a longitudinally extending tongue received in said groove of said third member when assembled therewith and removable from such groove when such top panel disengages from such side panels, one of said third and fourth members fixed and sealed to said expansion joint and extending between said laterally spaced apart side panels and the other of said third and fourth members fixed and sealed to one of said adjacent top panels along a side edge thereof, a fifth member having a longitudinally extending groove, a sixth member having a longitudinally extending tongue received in said groove of said fifth member when assembled therewith and removable from such groove when such top panel disengages from such side panels, one of said fifth and sixth members fixed and sealed to said expansion joint and extending between the laterally spaced apart side panels and the other of said fifth and sixth members fixed and sealed to the other of said adjacent top panels along a side edge thereof, a flexible and at least somewhat compressible cord rope of a thermally resistant material received in and extending longitudinally of said groove of each of said third and fifth members, and when the top panels are carried by the side panels said tongues of said fourth and sixth members are received in their associated grooves of said third and fifth members and bear on and compress their associated cord ropes received therein to thereby provide a releasable seal between the top panels, associated side panels and expansion joint.

7. The oven of claim 6 wherein each of said third and fifth members has first and second legs integrally connected by a return bend to define said groove with said legs converging toward each other adjacent the open end of said groove to facilitate retention of said cord rope in said groove without preventing the cover from being forced generally vertically upward in the event of an explosion in the oven.

8. The oven of claim 7 wherein one of said legs terminates adjacent its free end in a portion inclined outwardly to both of said legs and constructed and arranged to guide the tongue into the groove.

9. The oven of claim 6 wherein the material of said cord rope comprises fiberglass.

10. The oven of claim 6 which also comprises thermal insulation received over said expansion joint and between said adjacent top panels, a cover plate overlying said expansion joint and insulation and secured to one of such adjacent top panels adjacent such one side edge thereof, a slide plate lapping and slidably engaged with said cover plate and secured to the others of such adjacent top panels adjacent such one side edge thereof, and said cover and slide plates overlie and cover the gap between such adjacent side edges of such adjacent top panels while permitting such top panels to expand and contract due to temperature changes.

11. The oven of claim 6 wherein said expansion joint has in cross-section a generally channel-shape with a pair of spaced apart legs and said third and fifth members are in integral part of said legs.

12. A baking oven having a direct flame heating system and which comprises: a plurality of modules each having a pair of upstanding and laterally spaced apart side panels, a top panel removably carried by such pair of side panels, first members fixed and sealed to each side panel adjacent its upper end and having a longitudinally extending groove, second members fixed and sealed to said top panel adjacent each of its ends and having a longitudinally extending tongue slidably received in said groove when assembled therewith and removable from said groove when such top panel disengages from such side panels, a flexible and compressible cord rope of a thermal resistant material received in and extending generally longitudinally of each groove, and when such top panel is carried by such side panels, each tongue is received in its associated groove and bears on and compresses the cord rope received therein to thereby provide a releasable seal between the top panel and such side panels of the modules.

13. The oven of claim 12 which also comprises, an expansion joint extending between said laterally spaced apart side walls and received between an adjacent pair of top panels, third and fourth members each fixed and sealed to said expansion joint and each having a longitudinal groove extending between said laterally spaced apart side panels, fifth and sixth members each fixed and sealed to an adjacent top panel along an adjacent side edge thereof and each having a tongue received in an associated groove of one of said third and fourth members when assesmbled therewith and removable from such groove when such top panels disengage from such side panels, a flexible and at least somewhat compressible cord rope of a thermally resistant material received in and extending longitudinally of each of said grooves of said third and fourth members, and when the top panels are carried by the side panels such tongues of said fifth and sixth members are received in their associated grooves of said third and fourth members and bear on and compress the cord rope therein to thereby provide a releasable seal between the top panels, associated side panels and expansion joint.

* * * * *

UNITED STATES PATENT AND TRADEMARK OFFICE

CERTIFICATE OF CORRECTION

PATENT NO. : 4,731,016

DATED : March 15, 1988

INVENTOR(S) : James M. Dixon

It is certified that error appears in the above—identified patent and that said Letters Patent is hereby corrected as shown below:

In Column 5, line 6 (Claim 1, line 6), please delete "tongue" and insert in lieu thereof -- groove --

Signed and Sealed this

Twentieth Day of September, 1988

*Attest:*

DONALD J. QUIGG

*Attesting Officer*

*Commissioner of Patents and Trademarks*